US008259097B2

(12) United States Patent
Kim et al.

(10) Patent No.: US 8,259,097 B2
(45) Date of Patent: Sep. 4, 2012

(54) BACKLIGHT ASSEMBLY, DISPLAY COMPRISING THE SAME AND CONTROL METHOD THEREOF

(75) Inventors: Tae-hoon Kim, Suwon-si (KR); Joon-hyun Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 759 days.

(21) Appl. No.: 12/396,799

(22) Filed: Mar. 3, 2009

(65) Prior Publication Data

US 2010/0007644 A1 Jan. 14, 2010

(30) Foreign Application Priority Data

Jul. 11, 2008 (KR) ..... 10-2008-0067553

(51) Int. Cl.
*G09G 5/00* (2006.01)

(52) U.S. Cl. ..... 345/212; 345/211; 315/291

(58) Field of Classification Search ..... None
See application file for complete search history.

(56) References Cited

U.S. PATENT DOCUMENTS

| | | | | |
|---|---|---|---|---|
| 7,781,982 | B2 * | 8/2010 | Tatsumi | 315/291 |
| 7,855,520 | B2 * | 12/2010 | Leng | 315/307 |
| 7,906,917 | B2 * | 3/2011 | Tripathi et al. | 315/291 |
| 2007/0164928 | A1 | 7/2007 | Lee | |
| 2009/0230875 | A1 * | 9/2009 | Sauerlaender et al. | 315/291 |

* cited by examiner

*Primary Examiner* — Jason Olson
(74) *Attorney, Agent, or Firm* — Sughrue Mion, PLLC

(57) ABSTRACT

A backlight assembly, a display device including the backlight assembly and a control method thereof are provided. The backlight assembly includes: a DC converter which converts input alternating current (AC) power into direct current (DC) power at various levels; a light source unit which has at least one point light source; and a power supply unit which receives the DC power output by the DC converter, converts the DC power into output power having a preset reference current level and supplies the output power to the light source unit.

22 Claims, 5 Drawing Sheets

BACKLIGHT ASSEMBLY, DISPLAY COMPRISING THE SAME AND CONTROL METHOD THEREOF

CROSS-REFERENCE TO RELATED APPLICATION

This application claims priority from Korean Patent Application No. 10-2008-0067553, filed on Jul. 11, 2008 in the Korean Intellectual Property Office, the disclosure of which is incorporated herein by reference.

BACKGROUND OF THE INVENTION

1. Field of the Invention

Apparatuses and methods consistent with the present invention relate to a backlight assembly, a display device comprising the backlight assembly and a control method thereof, and more particularly, to a backlight assembly which includes a light emitting diode (LED), a display device comprising the same and a control method thereof.

2. Description of the Related Art

In recent years, flat display devices such as a liquid crystal display (LCD), a plasma display panel (PDP) and an organic light emitting diode (OLED) have increasingly replaced cathode ray tubes (CRT).

As a liquid crystal panel of the LCD does not emit light itself, it has a backlight unit in a rear side thereof to receive light. Transmittance of light that is emitted by the backlight unit is adjusted by arrangement of liquid crystals. The liquid crystal panel and the backlight unit are accommodated in an accommodating member such as a chassis. A light source which is used in the backlight unit may include a linear light source such as a lamp or a point light source such as a light emitting diode (LED). Among them, the LED has drawn a lot of attention lately.

The LCD also includes a power driver which converts a state of input power to supply power to a light source. The power driver is typically divided into several block units. Generally, the number of light sources in the backlight unit is increased as the panel size of the LCD is enlarged, and as a result the number of the power drivers is increased. Consequently, the size of the backlight unit is increased and the configuration of the power drivers becomes complicated.

SUMMARY OF THE INVENTION

Accordingly, it is an aspect of the present invention to provide a backlight assembly which provides better efficiency and is slimmer, and a display device comprising the same and a control method thereof.

Also, it is another aspect of the present invention to provide a backlight assembly which has a simple configuration and reduces manufacturing costs, a display device comprising the same and a control method thereof.

Further, it is another aspect of the present invention to provide a backlight assembly which produces less heat, a display device comprising the same and a control method thereof.

According to an aspect of the present invention, there is provided a backlight assembly, including: a direct current (DC) converter which converts input alternating current (AC) power into DC power at various levels; a light source unit which includes at least one point light source; and a power supply unit which receives the DC power output by the DC converter, converts the DC power into output power having a preset reference current level and supplies the output power to the light source unit.

The power supply unit may include: a switch which switches on and off the DC power; a transformer which is connected between the switch and the light source unit; a current detector which detects a current flowing in the light source unit; and a controller which controls the switch to make the detected current reach the reference current level.

The controller may include a comparator which compares a level of the detected current with the reference current level.

The power supply unit further includes an error detector which detects an error of the light source unit by comparing a voltage level of the output power with a preset or predetermined allowable range.

The error detector may compare an output voltage between the transformer and the light source unit with a predetermined reference voltage.

The reference voltage may be set as approximately 40% to 60% of a normal output voltage between the transformer and the light source unit when the light source unit does not have an error, and the controller may cut off power supplied to the light source unit if the output voltage is lower than the reference voltage.

The light source unit may include a plurality of light source modules, and the power supply unit may include a plurality of supply modules to separately supply power to the light source modules.

According to another aspect of the present invention, there is provided a display device which has a liquid crystal panel, the display device including: a DC converter which converts input AC power into DC power at various levels; a light source unit which includes at least one point light source and emits light to the liquid crystal panel; and a power supply unit which receives the DC power output by the DC converter, converts the DC power into output power having a preset reference current level and supplies the output power to the light source unit.

The power supply unit may include a switch to switch on and off input power; a transformer which is connected between the switch and the light source unit; a current detector which detects a current flowing in the light source unit; and a controller which controls the switch to make a level of the detected current reach the reference current level.

The power supply unit further includes an error detector which detects an error of the light source unit by comparing a voltage level of the output power with a preset allowable range.

The error detector may compare an output voltage between the transformer and the light source unit, and a reference voltage set as approximately 40% to 60% of a normal output voltage between the transformer and the light source unit when the light source unit does not have an error, and the controller may cut off power supplied to the light source unit if the output voltage is lower than the reference voltage.

The light source unit may include a plurality of light source modules, and the power supply unit includes a plurality of supply modules to separately supply power to the light source modules.

The liquid crystal panel may have a rectangular shape, and the light source modules may be provided in a rear side of the liquid crystal panel along at least one lateral side of the liquid crystal panel.

According to another aspect of the present invention, there is provided a control method of a display device which has a liquid crystal panel and a light source unit emitting light to the liquid crystal panel, the control method including: converting input AC power into DC power at various levels to supply the DC power to the light source unit; and converting the DC power into output power having a preset reference current level to supply the output power to the light source unit.

The supplying the output power to the light source unit may include detecting a current flowing in the light source unit; and controlling the output power to make a level of the detected current reach the reference current level.

The control method further includes comparing a voltage level of the output power supplied to the light source unit with a preset allowable range to detect an error of the light source unit.

The detecting the error may include comparing a voltage of the output power supplied to the light source unit with a preset reference voltage, and cutting off power supplied to the light source unit if the output voltage is lower than the reference voltage.

BRIEF DESCRIPTION OF THE DRAWINGS

The above and/or other aspects of the present invention will become apparent and more readily appreciated from the following description of the exemplary embodiments, taken in conjunction with the accompanying drawings of which.

DETAILED DESCRIPTION OF EXEMPLARY EMBODIMENTS OF THE INVENTION

Hereinafter, exemplary embodiments of the present invention will be described with reference to accompanying drawings, wherein like numerals refer to like elements and repetitive descriptions will be avoided as necessary.

Figure 1:
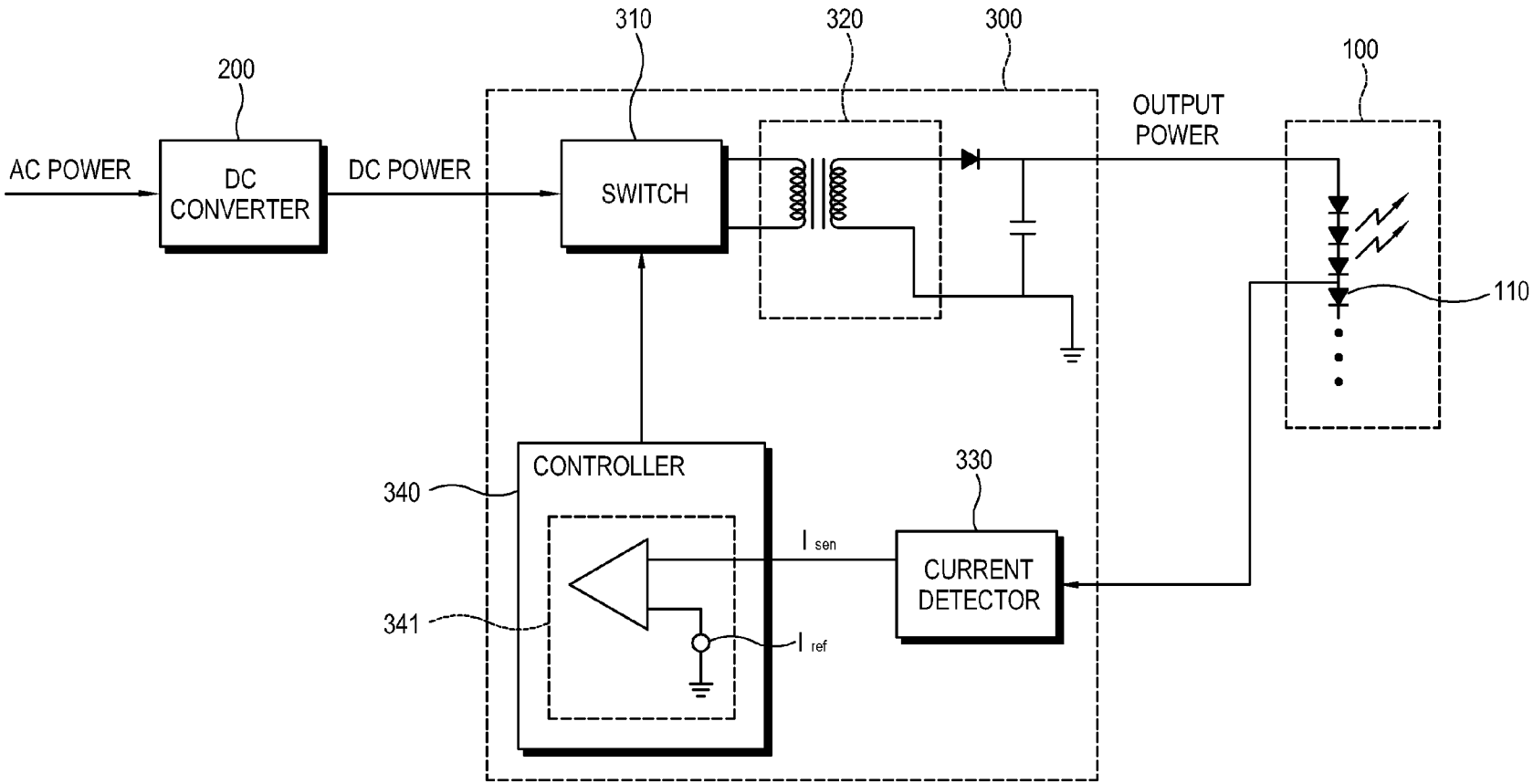
FIG. 1 is a control block diagram of a backlight assembly according to a first exemplary embodiment of the present invention.

FIG. 1 is a control block diagram of a backlight assembly according to a first exemplary embodiment of the present invention. As shown therein, the backlight assembly includes a light source unit 100, a DC converter 200 and a power supply unit 300.

The light source unit 100 includes at least one point light source 110, and emits light according to input power. The point light source 110 according to the present exemplary embodiment includes a light emitting diode (LED) that is formed in an LED circuit substrate (not shown). The point light source 110 may include an LED group (not shown) which emits different colored light such as red, green and blue light. The LED group includes three or four LEDs, and may further include a white LED. The point light sources 110 which emit the same color are connected in series to form a point light source string. If current control is needed to emit light, the light source is not limited to the point light source or LED. Herein, the term current control means a constant control of a current level with respect to supplied power. According to the present exemplary embodiment, the current level of power supplied to the light source unit 100 is consistently controlled. On the other hand, if the level of voltage supplied to the light source is consistently controlled, it is called voltage control.

The DC converter 200 receives input AC power and converts the input AC power into DC power, and outputs the converted DC power to the power supply unit 300. The DC converter 200 converts input AC power into DC power, but does not control the level of DC power. Thus, the DC power that is output by the DC converter 200 has various levels from 200V to 400V. The DC converter 200 may include a power saving circuit which provides a power factor correction (PFC) to raise power efficiency.

The power supply unit 300 receives the DC power output from the DC converter 200 and converts the DC power into output power that has a predetermined reference current level to be output to the light source unit 100. That is, the power supply unit 300 receives DC power that does not have a consistent voltage level, and converts the DC power into output power having a predetermined reference current level, i.e., constant-current power. The power supply unit 300 is a single block unit that is provided between the DC converter 200 and the light source unit 100 to be directly connected to the DC converter 200 and the light source unit 100.

In the related art, the power driver which supplies driving power to the light source of the backlight assembly typically has been formed as several block units. For example, the power driver may be classified into a block unit to supply DC power with AC power, a converter block unit to convert DC power into a voltage at a consistent level and a light source driver block unit to adjust a consistent voltage to supply a current at a consistent level to the light source. In this case, input power should go through the three block units to be thereafter supplied to the light source. The nature of the power is changed corresponding to each block unit through which the power travels and the efficiency of power is reduced by each block unit. For example, if the power efficiency of each block unit is 90%, a total efficiency after the three block units is approximately 73% In other words, more than 27% of the power is consumed as heat, and as a result a heating related problem may arise. Also, as the number of the light sources increases, the number of block units also increases to supply driving power that may adversely affect a thin backlight assembly.

According to the present exemplary embodiment, input AC power is supplied to the light source unit 100 after going through two block units, namely, the DC converter 200 and the power supply unit 300. Since the number of block units is reduced to from three block units to two block units, a power supply configuration is made simpler, efficiency is improved and the risk of a heating problem is reduced. Also, manufacturing costs of the backlight assembly are decreased, and a size of the power supply is reduced such that a thin backlight assembly may be produced.

The power supply unit 300 includes a switch 310, a transformer 320, a current detector 330 and a controller 340 to control the foregoing elements. The power supply unit 300 may be a switching-mode power supply (SMPS).

The switch 310 includes a plurality of switching elements (not shown), and controls DC power according to a control signal output by the controller 340. The switching elements may apply various known technologies such as a bridge type and a half bridge type.

The transformer 320 is connected between the switch 310 and the light source unit 100, and raises a voltage of power output by the switch 310 according to a turns ratio of the transformer 320 to output the power to the light source unit 100. A diode and a capacitor are provided between the transformer 320 and the light source unit 100. The current level of output power output by the transformer 320 is controlled to remain consistent.

The current detector 330 detects a current $I_{sen}$ flowing in the light source unit 100, and outputs the current to the controller 340. The current detector 330 may include a resistor (not shown), a current amplifier (not shown) and a filter (not shown) to reduce noise of output current.

The controller 340 controls on/off of the switch 310 to make the detected current $I_{sen}$ become substantially equal to a reference current level $I_{ref}$. The controller 340 includes a comparator 341 which compares the detected current level $I_{sen}$ with the reference current level $I_{ref}$. An input terminal of the comparator 341 is connected to power having the reference current level $I_{ref}$. If the detected current level $I_{sen}$ is lower than the reference current level $I_{ref}$, the controller 340 controls the switch 310 to increase the current level of the output power. If the detected current level $I_{sen}$ is higher than the reference current level $I_{ref}$, the controller 340 controls the switch 310 to decrease the current level of the output power so that the current level of the output power remains consistent. That is, the controller 340 controls the switch 310 to output the input DC power as constant current at a consistent level, to thereby perform a current control.

The controller 340 may receive a control signal regarding dimming of the light source unit 100 and control the switch 310 accordingly. If the backlight assembly is utilized to provide light to a display panel such as an LCD, brightness of the light source may be adjusted according to an image signal displayed on the display panel. For example, the brightness of the light source unit 100 may be raised corresponding to an image with a bright gray scale, and may be reduced according to an image with a dark gray scale. That is, a local dimming of the light source 100 is available.

Figure 2:
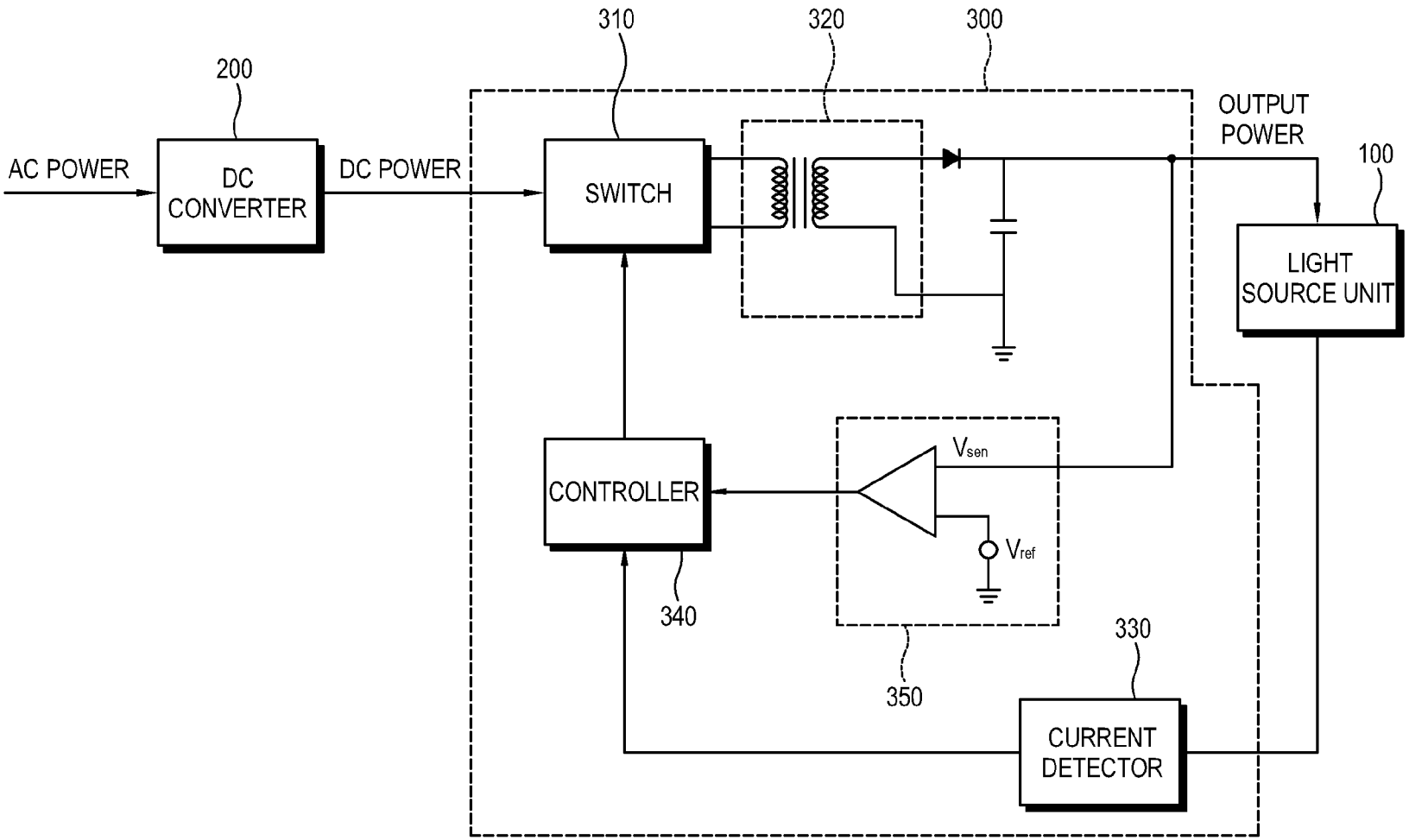
FIG. 2 is a control block diagram of a backlight assembly according to a second exemplary embodiment of the present invention.

FIG. 2 is a control block diagram of a backlight assembly according to a second exemplary embodiment of the present invention.

As shown therein, a power supply unit 300 according to the present exemplary embodiment further includes an error detector 350. Other than the error detector 350, the elements of the backlight assembly are the same as those of the backlight assembly according to the first exemplary embodiment.

The error detector 350 compares a voltage level of output power supplied to the light source unit 100, i.e., an output voltage $V_{sen}$, with a preset or predetermined allowable voltage range, and determines whether the output voltage $V_{sen}$ is out of the allowable range. The error detector 350 may include a comparator, e.g., an operational amplifier, which compares voltage $V_{sen}$ output from a transformer 320 to the light source unit 100 with a predetermined reference voltage $V_{ref}$. The reference voltage $V_{ref}$ is set as approximately 40% to 60%, and more preferably, as 50% of a normal output voltage corresponding to an average voltage between the transfer 320 and the light source unit 100 when there is no error. This is to minimize miscalculation about noise in consideration of noise due to voltage detection. If the output voltage $V_{sen}$ is between the reference voltage $V_{ref}$ and the normal output voltage, the error detector 350 may determine that the light source unit 100 is in a normal state. If the output voltage $V_{sen}$ is higher or lower than the range, the error detector 350 may determine that the light source unit 100 has an error. The voltage comparison mechanism of the error detector 350 may vary. The reference voltage $V_{ref}$ may be set as the normal output voltage. A plurality of reference voltages may be set to determine the extent of errors. The error detector 350 may include an analog-to-digital (A/D) converter and a digital processor instead of the operational amplifier.

The controller 340 controls the switch 310 to maintain the output voltage $V_{sen}$ at a consistent level according to a signal output by the error detector 350 or to switch off the output power depending on the level of errors. For example, if the point light sources 110 are all open, the current detector 330 does not detect any current by not forming a closed circuit in which current flows. In this case, the comparator 340 determines that power supply is insufficient and the output power supplied to the light source unit 100 increases. Even if the output power increases, the output voltage $V_{sen}$ rises gradually and the power supply unit 300 becomes overheated because the current is not detected. As a result, elements of the switch 310 may be damaged. Even if all the point light sources 110 of the light source unit 100 are short-circuited, the point light sources 110 act as a large resistor and a current close to zero is detected. If the point light sources 110 are partially open or short-circuited, a normal current does not flow in the point light sources 110, and the output voltage $V_{sen}$ does not have the normal level. If the level of the output voltage $V_{sen}$ is between the reference voltage $V_{ref}$ and the normal output voltage, the controller 340 controls the output voltage $V_{ref}$ to reach the normal output voltage. If the error is not serious enough to cut off power even if the point light sources 110 are partially short-circuited or open, the controller 340 controls on/off of the switch 310 to have desired brightness with the remaining point light sources 110. On the other hand, if the output voltage $V_{sen}$ is outside of the range, the controller 340 determines that serious errors have occurred in the point light sources 110 and cuts off power supplied to the point light sources 110 or controls to supply minimal power. The controller 340 performs a constant-current control to provide a consistent current flow in the point light sources 110 and at the same time performs a constant-voltage control to prevent damage to the elements due to errors of the point light sources 110.

According to another exemplary embodiment, the power supply unit 300 may further include a storage unit to store error occurrence information about errors of the light source 100 and the type of errors therein.

According to another exemplary embodiment, the power supply unit 300 may display the occurred error to let a user know the problem of the light source unit 100 if the point light sources 110 have errors such as a short circuit or an open circuit. An error alarming unit may include a light emitting diode which is turned on in response to errors or an audio output unit to output a siren or a specific sound. The power supply unit 300 may display a UI screen to display the errors occurred.

Figure 3:
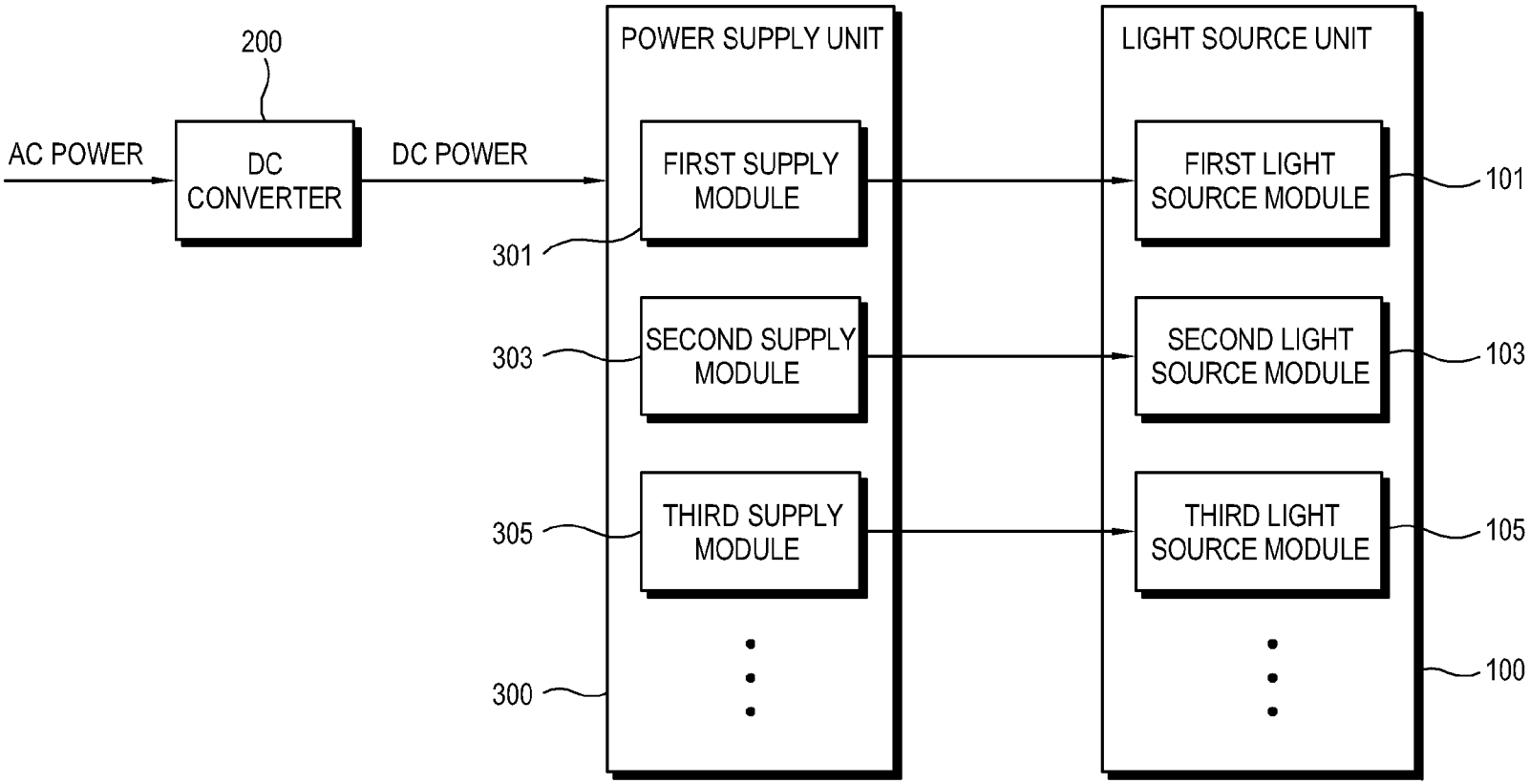
FIG. 3 is a control block diagram of a backlight assembly according to a third exemplary embodiment of the present invention.

FIG. 3 is a control block diagram of a backlight assembly according to a third exemplary embodiment of the present invention.

The backlight assembly according to the present exemplary embodiment includes a light source unit 100 having a plurality of light source modules 101, 103 and 105 and a power supply unit 300 having a plurality of supply modules 301, 303 and 305. As shown in FIG. 1 or 2, the respective light source modules 101, 103 and 105 include a point light source string while the respective supply modules 301, 303 and 305 include a switch 310, a transformer 320 and a controller 340. The supply modules 301, 303 and 305 supply power to the light source modules 101, 103 and 105, respectively.

As described above, if the light source units 101 are divided into a plurality of blocks to be controlled, brightness of emitted light may be partly controlled. Gray scale of images may be reflected in the brightness of light or the light source modules 101, 103 and 105 may sequentially be driven.

Figure 4:
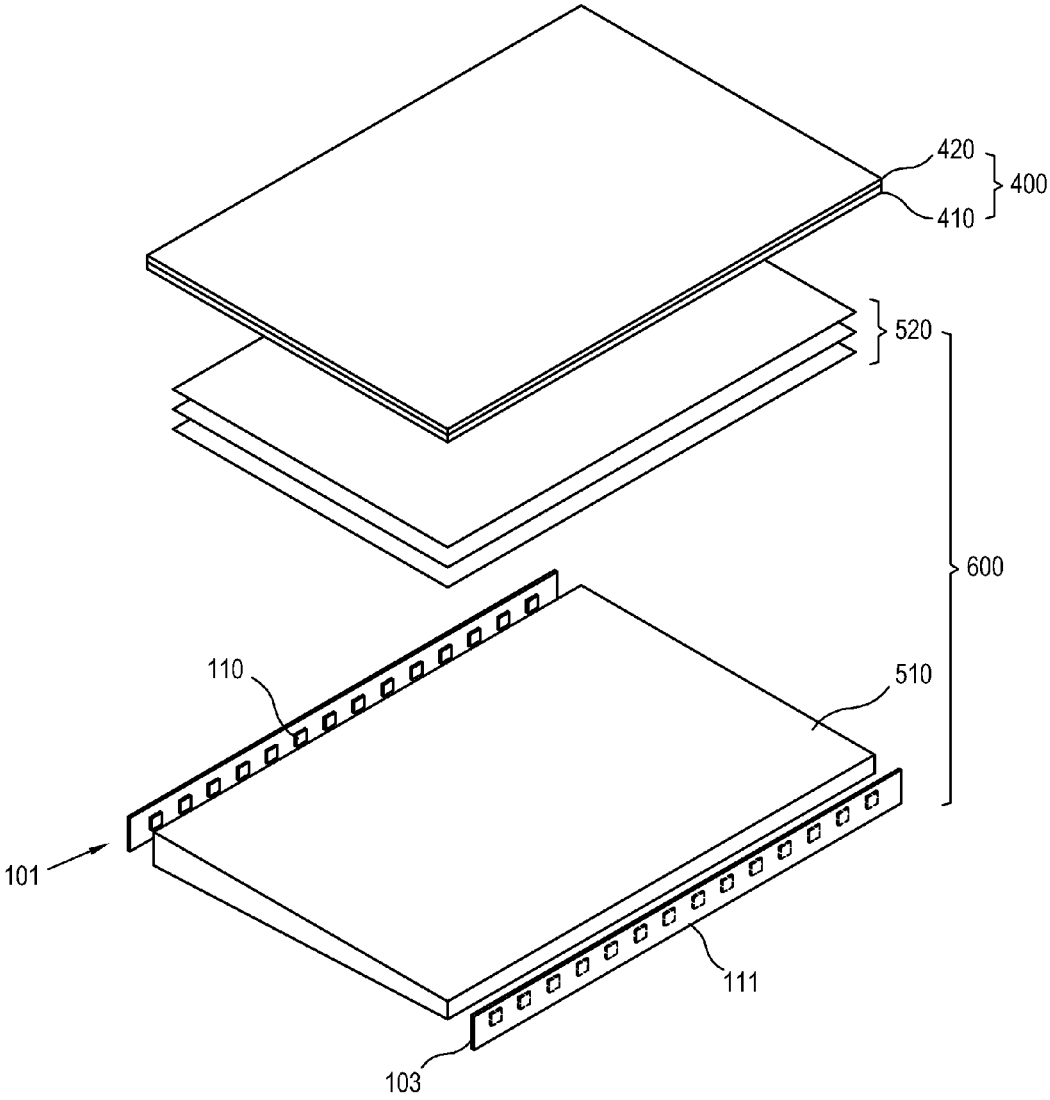
FIG. 4 is a brief perspective view of a display device including the backlight assembly according to the present invention.

FIG. 4 is a brief perspective view of the display device including the backlight assembly according to the present invention. The display device includes a liquid crystal panel 400 having a liquid crystal layer (not shown) and a backlight assembly 600 supplying light to the liquid crystal panel 400. The liquid crystal panel 400 includes a first substrate 410 having a thin film transistor (not shown), a second substrate 420 and a liquid crystal layer interposed between the first and second substrates 410 and 420. The liquid crystal panel 400 has a rectangular shape, and includes a plurality of pixels (not shown) in a matrix pattern with a thin film transistor.

The backlight assembly 600 includes first and second light source modules 101 and 103, a light guiding plate 510 interposed between the light source modules 101 and 103 and a light adjusting member 520 provided between the liquid crystal panel 400 and the light guiding plate 510.

Each of the first light source module 101 and the second light source module 103 include a point light source 110 arranged on a point light source circuit substrate 111. The light guiding plate 510 guides light emitted by the light source modules 101 and 103 to the liquid crystal panel 400 while the light adjusting member 520 uniformly adjusts brightness of the light guided by the light guiding plate 510.

The backlight assembly 600 according to the present exemplary embodiment is an edge type in which light sources are provided along two lateral sides of the liquid crystal panel 400 from a rear surface thereof. The plurality of light source modules 101 and 103 of the light source unit 100 provides more efficiency in an edge type having a limited number of arranged light sources rather than in a direct type having light sources uniformly arranged. More light source modules of the direct type backlight assembly require more supply modules, making the backlight assembly thicker. The edge type has a limited number of light source modules 101 and 103 and the power supply block units are reduced to two. Thus, the backlight assembly 600 and the display device are slimmer.

Figure 5:
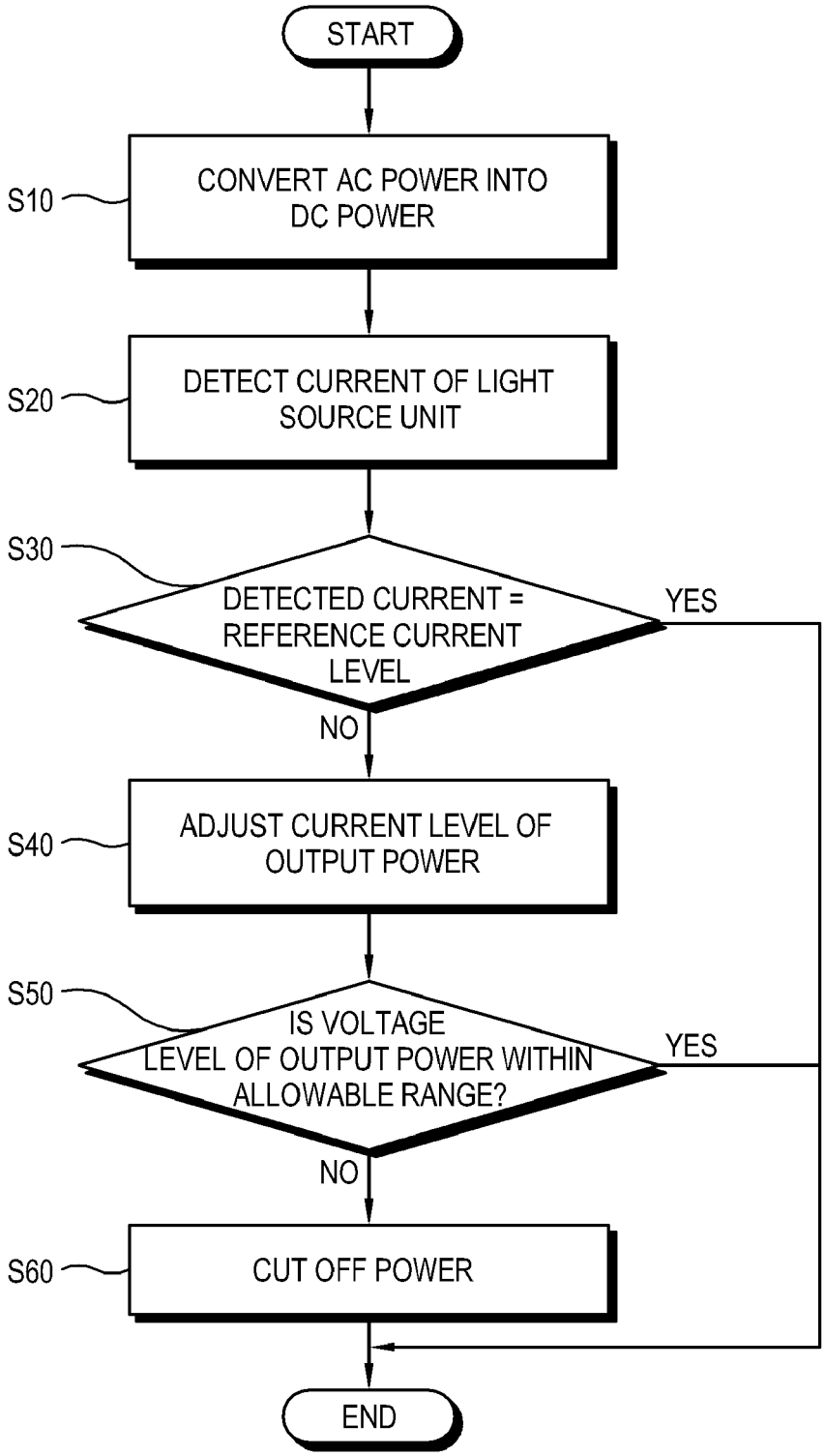
FIG. 5 is a control flowchart to describe a control method of the display device in FIG. 4.

Referring to FIG. 5, a control method of the display device in FIG. 4 according to an present exemplary embodiment will be described.

First, the DC converter 200 converts input AC power into DC power at various levels (S110).

If the light source unit 100 receives power, the current detector 330 detects a current flowing in the point light sources 110 (S20).

The controller 340 determines whether the detected current level is the reference current level so as to adjust the level of the detected current to the reference current level (S30).

If it is determined that the detected current level is not equal to the reference current level, the controller 340 controls the switch 310 to adjust the current level of the output power to the reference current level (S40). That is, the controller 340 performs a constant current control to stably supply a current to the light source unit 100.

The controller 340 determines whether the voltage level of the output power supplied to the light source unit 100 is within the allowable range to detect errors of the light source unit 100 (S50).

If the voltage of the output power is out of the preset allowable range, the controller 340 controls the switch 310 to cut off power supplied to the light source unit 100 thereby protecting the power supply unit 300 (S60).

As described above, the present invention reduces the configuration of the power supply unit to two block units and performs constant voltage and constant current controls at the same time through a single block unit.

As described above, the present invention provides a backlight assembly which is slimmer and improves efficiency, a display device comprising the same and a control method thereof.

Also, the present invention provides a backlight assembly which has a simple configuration and reduces manufacturing costs, a display device comprising the same and a control method thereof.

Further, the present invention provides a backlight assembly which produces less heat, a display device comprising the same and a control method thereof.

Further, the present invention provides a backlight assembly which detects errors of a light source unit, a display device comprising the same and a control method thereof.

Further, the present invention provides a backlight assembly which protects a power supply unit supplying power to a light source unit, a display device comprising the same and a control method thereof.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A backlight assembly comprising:

a DC converter which converts input alternating current (AC) power into direct current (DC) power;

a light source unit which includes at least one point light source;

a power supply unit which receives the DC power output by the DC converter, converts the DC power into output power having a preset reference current level and supplies the output power to the light source unit; and an error detector which detects an error of the light source unit by comparing a voltage level of the output power with a preset range that is defined by a predetermined reference voltage and a normal voltage value, and detects the error if the voltage level of the output power is determined to be outside of the preset range.

2. The backlight assembly according to claim 1, wherein the power supply unit comprises:

a switch which receives the DC power output by the DC converter and switches on and off to control a current level of the DC power;

a transformer which is connected between the switch and the light source unit and transforms a voltage of the DC power output by the switch;

a current detector which detects a current flowing in the light source unit; and a controller which controls the switch to make the detected current become substantially equal to the reference current level.

3. The backlight assembly according to claim 2, wherein the controller comprises a comparator which compares a level of the detected current with the reference current level.

4. The backlight assembly according to claim 2, wherein the switch receives the DC power output by the DC converter directly from the DC converter and is connected between the DC converter and the transformer.

5. The backlight assembly according to claim 1, wherein the error detector compares the voltage level of the output power between the transformer and the light source unit with the predetermined reference voltage.

6. The backlight assembly according to claim 5, wherein the predetermined reference voltage is set as approximately 40% to 60% of the normal output voltage between the transformer and the light source unit when the light source unit does not have an error, and the controller controls the switch to cut off power supplied to the light source unit if the output voltage is lower than the predetermined reference voltage.

7. The backlight assembly according to claim 6, the controller controls the switch to cut off power supplied to the light source unit if the output voltage is determined to be outside the predetermined range.

8. The backlight assembly according to claim 1, wherein the light source unit comprises a plurality of light source modules, and the power supply unit comprises a plurality of supply modules to separately supply power to the light source modules.

9. A display device which has a liquid crystal panel, the display device comprising:

a DC converter which converts input alternating current (AC) power into direct current (DC) power;

a light source unit which includes at least one point light source and emits light to the liquid crystal panel;

a power supply unit which receives the DC power output by the DC converter, converts the DC power into output power having a preset reference current level and supplies the output power to the light source unit; and an error detector which detects an error of the light source unit by comparing a voltage level of the output power with a preset range that is defined by a predetermined reference voltage and a normal voltage value, and detects the error if the voltage level of the output power is determined to be outside of the preset range.

10. The display device according to claim 9, wherein the power supply unit comprises:

a switch which receives the DC power output by the DC converter and switches on and off to control a current level of the DC power;

a transformer which is connected between the switch and the light source unit and transforms a voltage of the DC power output by the switch;

a current detector which detects a current flowing in the light source unit; and a controller which controls the switch to make a level of the detected current become substantially equal to the reference current level.

11. The display device according to claim 9, wherein the error detector compares the voltage level of the output power between the transformer and the light source unit, and the predetermined reference voltage set as approximately 40% to 60% of the normal output voltage between the transformer and the light source unit when the light source unit does not have an error, and the controller controls the switch to cut off power supplied to the light source unit if the output voltage is lower than the predetermined reference voltage.

12. The display device according to claim 11, the controller controls the switch to cut off power supplied to the light source unit if the output voltage is determined to be outside the predetermined range.

13. The display device according to claim 9, wherein the light source unit comprises a plurality of light source modules, and the power supply unit comprises a plurality of supply modules to separately supply power to the light source modules.

14. The display device according to claim 13, wherein the liquid crystal panel has a rectangular shape, and the light source modules are provided in a rear side of the liquid crystal panel along at least one lateral side of the liquid crystal panel.

15. A control method of a display device which has a liquid crystal panel and a light source unit emitting light to the liquid crystal panel, the control method comprising:

converting input alternating current (AC) power into direct current (DC) power;

converting the DC power into output power having a preset reference current level;

supplying the output power to the light source unit; and detecting an error of the light source unit by comparing a voltage level of the output power with a preset range that is defined by a predetermined reference voltage and a normal voltage value, wherein the error is detected if the voltage level of the output power is determined to be outside of the preset range.

16. The control method according to claim 15, further comprising:

detecting a current flowing in the light source unit; and controlling the output power to make a level of the detected current become substantially equal to the reference current level.

17. The control method according to claim 16, wherein the detecting the error comprises:

comparing the voltage level of the output power supplied to the light source unit with the preset reference voltage, and cutting off power supplied to the light source unit if the output voltage is lower than the reference voltage.

18. A backlight assembly comprising:

a light source unit;

a power supply unit which converts direct current power to output power and supplies the output power to the light source unit, wherein the power supply unit comprises a current detector which detects a current flowing through the light source unit, and the power supply unit controls a current level of the output power to be maintained at a reference current level based on the detected current flowing through the light source unit; and an error detector which determines whether the light source unit has an error by determining whether a voltage level of the output power is within a predetermined range that is defined by a predetermined reference voltage and a normal voltage value, and detects the error if the voltage level of the output power is determined to be outside of the preset range.

19. The backlight assembly of claim 18, wherein the power supply unit further comprises a switch which is switched on and off to control the current level of the output power based on the detected current and a controller which compares the detected current to the reference current level, controls the switch to increase the current level of the output power if the detected current level is less than the reference current level, and controls the switch to decrease the current level of the output power if the detected current level is greater than the reference current level.

20. The backlight assembly of claim 19, wherein the the controller controls the switch to maintain the voltage level of the output power at a consistent level, if the error is not detected, or switch off the output power, if the error is detected, based on a result of the determination by the error detector.

21. A control method of a backlight assembly including a light source unit and a power supply unit which comprises a switch, the control method comprising:

converting direct current power to output power and supplying the output power to the light source unit;

detecting a current flowing through the light source unit;

controlling a current level of the output power to be maintained at a reference current level based on the detected current flowing through the light source unit;

determining whether the light source unit has an error by determining whether a voltage level of the output power is within a predetermined range that is defined by a predetermined reference voltage at a lower threshold and a normal voltage value at an upper threshold; and controlling the switch to maintain the voltage level of the output power at a consistent level, if the error is not detected, or switch off the output power, if the error is detected, based on a result of the determination by the error detector.

22. The control method of claim 21, wherein the controlling the current level comprises comparing the detected current to the reference current level;

controlling the switch to increase the current level of the output power if the detected current level is less than the reference current level; and controlling the switch to decrease the current level of the output power if the detected current level is greater than the reference current level.

* * * * *